United States Patent [19]

Buckley

[11] Patent Number: 4,689,852

[45] Date of Patent: Sep. 1, 1987

[54] FRICTION SUPPORTED STAYS FOR WINDOWS

[75] Inventor: John E. Buckley, Tewkesbury, United Kingdom

[73] Assignee: Securistyle Limited, Nottingham, England

[21] Appl. No.: 799,559

[22] Filed: Nov. 20, 1985

Related U.S. Application Data

[63] Continuation of Ser. No. 560,559, Dec. 12, 1983, abandoned.

[30] Foreign Application Priority Data

Dec. 24, 1982 [GB] United Kingdom ..... 8236777

[51] Int. Cl.[4] ..... E05C 17/04

[52] U.S. Cl. ..... 16/341; 16/363; 49/252

[58] Field of Search ..... 16/370, 371, 368, 369, 16/337, 341, 345, 352, 323, 362, 363; 49/252, 248, 260, 246, 250

[56] References Cited

U.S. PATENT DOCUMENTS

| | | | |
|---|---|---|---|
| 1,114,260 | 10/1914 | Hauser | 49/252 |
| 1,444,223 | 2/1923 | Tuomi | 49/252 |
| 1,855,698 | 4/1932 | Taylor | 49/248 |
| 2,416,511 | 2/1947 | Blanck | 49/260 |
| 2,950,509 | 8/1960 | Stavenau | 16/337 |
| 3,122,799 | 3/1964 | Lunde | 49/252 |
| 4,226,002 | 10/1980 | Davis | 16/287 |

FOREIGN PATENT DOCUMENTS

| | | | |
|---|---|---|---|
| 896552 | 5/1962 | United Kingdom | 49/252 |
| 2047309 | 11/1980 | United Kingdom . | |
| 2047309B | 1/1983 | United Kingdom . | |

*Primary Examiner*—Donald R. Schran
*Assistant Examiner*—James L. Wolfe
*Attorney, Agent, or Firm*—Jerry W. Mills; Gregory M. Howison

[57] ABSTRACT

A friction supported stay comprising a track (10) secured vertically to a window frame with a slider (15) connected by link (18) to a strut (16) in turn connected to bar (24) which is also connected to slider (15) by a link (21). The bar, which is normally connected to the window has a nose member (35) which engages in a plastic, shaped cap member (14). The cap member (14) has internal cam surfaces (36) (37) which are asymmetrically disposed with respect to the central longitudinal axis of the track. One cam surface is at a greater angle to the axis than the other. The corresponding surfaces of the nose portion (35) of strut (24) are similarly inclined to each other and to the axis of strut (24).

8 Claims, 2 Drawing Figures

FRICTION SUPPORTED STAYS FOR WINDOWS

This application is a continuation of application Ser. No. 560,559, filed 12/12/83, now abandoned.

TECHNICAL FIELD OF THE INVENTION

The invention relates to friction supporting stays, for windows, or the kind comprising a tract, a slider movable along the track, a strut pivotally connected to the track, a brace pivotally connected between the slider and the strut, a link pivotally connected to the slider, and a bar pivotally connected to the link and to the strut, the arrangement being such that as the slider moves along the track the bar can swing from a position overlying the track to a position where it is angled with respect to the track.

BACKGROUND OF THE INVENTION

The invention relates to friction supporting stays, for windows, of the kind comprising a track, a slider movable along the track, a strut pivotally connected to the track, a brace pivotally connected between the slider and the strut, a link pivotally connected to the slider, and a bar pivotally connected to the link and to the strut, the arrangement being such that as the slide moves along the track the bar can swing from a position overlying the track to a position where it is angled with respect to the track.

In use, two such supporting stays are normally provided at opposite sides of a window, the track of each stay being mounted on the window frame and the bar being mounted on the window sash. The arrangement is such that as the window pivots on the stays, about either a vertical or a horizontal axis, the axis of pivoting of the window sash moves away from the window frame so that when the window is open both sides thereof are accessible from one side of the window frame.

The window sash is frictionally restrained in any angular position to which it is set. This frictional restraint may be provided partly by the friction at the pivotal connections between the various elements but is largely provided by the frictional engagement between the slider and the track.

In friction supporting stays of this kind, the end of the track remote from the strut is normally provided with a cap member providing two internal cam surfaces meeting at an apex, and the end of the bar which overlies the track when the stay is in the closed position is provided with a correspondingly shaped nose portion which enters the cap member and engages the cam surfaces with a wedging action as the stay is moved into the closed position.

Normally, the shape of the cap member and the shape of the nose portion are symmetrical so that the stay may be opened in either direction from the closed position. However, in stays above a certain size, for use with large windows, there is inevitably some deflection of the components of the stay due to the weight of the window and it is sometimes found that, due to this deflection, the nose portion on the bar becomes displaced from its designed path of movement as the window is closed so that it does not enter the cap member and engage the cam surfaces but instead strikes the outer surface of the cap member. The present invention provides a modified shape of cap member and nose portion in such a stay to overcome this problem and thus render the stay suitable for use in large sizes and with heavy windows.

SUMMARY OF THE INVENTION

According to the invention, in a friction stay of the kind last referred to, the internal cam surfaces on the cap member are asymmetrically disposed with respect to the central longitudinal axis of the track, one cam surface being at a greater angle to the axis than the other, the corresponding surfaces on the nose portion of the bar being correspondingly inclined.

Preferably the apex between the two inclined cam surfaces on the cap member is displaced to one side of the central longitudinal axis of the track, so that the surface inclined at a greater angle to the axis intersects the axis.

Preferably one of said cam surfaces is so disposed as to prevent movement of the bar past the track in one direction. For example, said surface may extend substantially parallel to the central longitudinal axis of the track. This means that the window on which the stay is fitted can then only be opened and closed to one side of the stay.

In friction stays of the kind first referred to, the strut is usually pivotally connected to the track by means of a rivet, and in the case where the track is channel-sectioned the web of the channel section may be domed upwardly where the rivet passes through it to provide a support for the end of the strut just above the side walls of the channel section. A disadvantage of this arrangement is that the metal of the web of the track is fairly thin and therefore engages only a short length of the shank of the rivet, providing little support against tilting of the rivet. With continued use of the stay, therefore, the metal of the track tends to become worn and/or deformed and the rivet becomes loose leading to inaccuracy in operation of the stay. A further aspect of the present invention therefore provides a mounting arrangement for the strut on the track which overcomes this disadvantage.

According to this aspect of the invention, in a friction stay of any of the kinds referred to above, the strut is pivotally mounted on a block which is secured to the track. The block, which may be formed from plastics, may be secured to the track by the same rivet which also pivotally connects the strut to the block. Alternatively or additionally the block may be secured to the track by further securing means.

In the case where the track is in the form of a channel having inturned flanges along the extremities of the side walls thereof, the block may be shaped to be located within said channel and formed with longitudinal recesses to receive said flanges.

Preferably the block has a surface portion which projects above the surface of the track to provide a bearing surface to prevent components of the stay, particularly the strut and brace, from binding against the track itself. Preferably the block extends along a substantial length of the track beyond the area of the pivot between the strut and the track.

BRIEF DESCRIPTION OF THE DRAWINGS

The following is a detailed description of an embodiment of the invention, by way of example, reference being made to the accompanying drawings in which.

DETAILED DESCRIPTION OF THE INVENTION

Figures 1, 2:
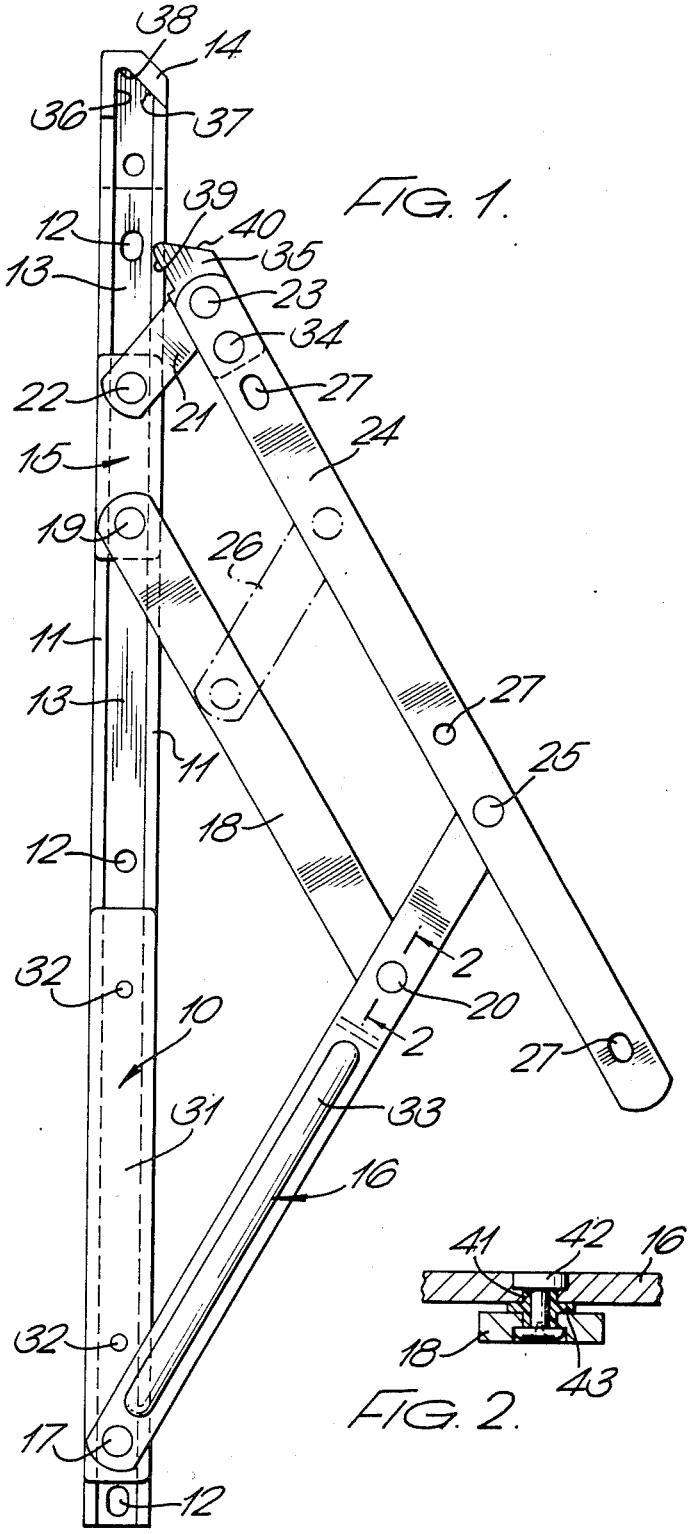
FIG. 1 is a plan view of a supporting stay according to the invention, shown in a partly open position.
FIG. 2 is a section, on an enlarged scale, through one of the pivot joints between two components of the stay.

Referring to FIG. 1, the supporting stay comprises a channel-sectioned track member 10 having longitudinal inturned flanges 11. The track member is, in use of the stay, normally secured vertically to the window frame, two stays being provided at opposite sides respectively of the window frame. Fixing holes 12 are provided in the web 13 of the track member to receive fixing screws. At its upper end the track memeber is closed by a plastics shaped cap member 14 which is plugged into the end of the track member and may be staked to the track member by deforming a part of the web, or secured by means of a rivet.

A slider 15 is slidable along the track member and is provided with longitudinal grooves to receive the flanges 11 of the track member. Thus the slider must be introduced into the track member before the cap member 14 is fitted.

An elongate cranked metal strut 16 is pivotally connected to the track member 10 by a rivet 17 which passes through an elongate plastics block 31 which is of similar cross-sectional shape to the slider 15 and is received within the channel of the track member, having longitudinal grooves to receive the flanges 11. The rivet 17 may pass through both the block 31 and the web 13 of the track member or it may pass only through the block 31, the block being secured to the track member by other means, for example by means of rivets 32.

An elongate brace 18 is pivotally connected at one end, by a rivet 19, to the slider 15 and at the opposite end thereof, by a rivet 20, to a part of the strut 16 intermediate the ends thereof. The strut 16 has a longitudinal channel 33, of curved cross-section, deformed out of the surface thereof to increase the rigidity of the strut.

A short link 21 is pivotally connected to the slider 15 by a rivet 22 at a location spaced from the rivet 19. The opposite end of the link 21 is pivotally connected by a rivet 23 to one end of a bar 24, which is in turn pivotally connected, intermedaite its ends, by a rivet 25 to the extremity of the strut 16. A cross-link 26, shown in chain lines, may be pivotally connected between the brace 18 and the bar 24, parallel to the strut 16, if required.

The bar 24 is, in use, connected to the side member of the window sash frame and fixing holes 27 are provided for this purpose.

In operation, the bar 24 may be swung from the angled position shown in FIG. 1, in which the window is open, to a closed position where the bar 24 overlies the track member 10 and the window is closed. The dimensions of the elements of the stay, and the positions of the rivets, are so chosen that the strut 16, brace 18 and link 21 also overlie the track member 10 when the window is in a closed position.

The upper end of the bar 24 has mounted thereon, by means of the rivet 23 and a further rivet 34, a nose member 35 which cooperates with the cap member 14 as the window is closed.

The cap member 14 is provided with two internal surfaces 36 and 37 which meet at an apex 38 which is displaced to one side of the central longitudinal axis of the track member 10. The surface 36 extends generally parallel to said axis and the surface 37 is inclined so as to intersect the axis. The nose member 35 on the bar 24 is formed with correspondingly shaped surfaces 39 and 40.

As the bar 24 moves to the closed position, the inclined surface 40 on the nose member 35 engages the inclined surface 37 on the cap 14 with a wedging action, bringing the surface 39 into abutting engagement with the surface 36. The surface 39 is formed in a rebate in the nose member 35 to permit the bar 24 to overlie the track. It will be seen that engagement between the surfaces 39 and 36 prevents the stay being opened to the left hand side of the track member 10, as viewed in FIG. 1. The asymmetric arrangement of the nose member 35 and cap member 14 ensures that the nose member enters the angle in the cap member even though the elements of the stay may be deflected due to the weight of a window mounted on the bar 24. As previously explained, in conventional friction stays the nose portion on the upper end of the bar 24 is so shaped that if the elements of the stay become deflected it is possible for the nose portion to strike the outer right hand side of the cap 14 and thus prevent the nose portion entering the cap.

It will be seen that since the slider 15 and block 31 each have portions thereof overlying the flanges 11 of the track member, they serve to prevent the elements of the stay, particularly the link 21, brace 18 and strut 16, from binding against the flanges of the track member, which might otherwise happen due to deflection of the stay elements under the weight of the window.

Any suitable form of pivotal connection may be employed between the elements of the stay, but FIG. 2 shows a preferred arrangement where a plastics bush 14 encircles the shank of the rivet 42 and is provided with an outwardly projecting peripheral flange 43 to separate the two components of the stay. It will be seen that the holes through the stay components are counterbored to receive the head and tail respectively of the rivet. The provision of the plastics bush around the rivet reduces metal-to-metal contact and thus reduces wear of the holes in the stay components which might otherwise lead to loosening of the pivotal connections and inaccurate operation of the stay.

I claim:

1. A friction supporting stay for being fitted to a window comprising:

a track;

a slider movable along said track;

a strut having first and second ends and pivotally connected at said first end to said track;

a brace having first and second ends and pivotally connected at said first end to said slider and pivotally connected at said second end to said strut between the first and second ends of said strut;

a link having first and second ends and pivotally connected at said first end to said slider;

a cap member disposed at the end of said track remote from the first end of said strut and having two internal cam surfaces perpendicular to the plane of said track and extending outward therefrom and meeting at an apex, the internal cam surfaces on said cap member being asymmetrically disposed with respect to the central longitudinal axis of the track, one cam surface being at a greater angle to the axis than the other; and a bar having first and second ends and pivotally connected at said first end proximate the second end of said link and pivotally connected to the second end of said strut at a point between the first and second ends of said bar and adapted so that as said slider moves along said track said bar swings from a closed position overlying said track to an open position angled with respect to said track, said bar having a nose portion formed at the first end thereof which has two external surfaces meeting at an apex and correspondingly shaped to co-operate with the two internal cam surfaces of said cap member and which enters said cap member and engages the two internal cam surfaces thereof with a wedging action as said bar is moved into the closed position;

said two external surfaces of said nose portion and said two internal cam surfaces of said cap member being disposed such that the apex of the two external surfaces of said nose portion is offset relative to the longitudinal axis of said bar toward the side thereof more proximate said track, the offset ensuring that said nose position enters said cap member even if said track, said strut, said brace, said link or said metal bar are deflected due to loading thereof.

2. The friction supporting stay of claim 1 wherein one of said two internal cam surfaces of said nose portion is so disposed as to prevent movement of said bar past said track in one direction.

3. The friction supporting stay of claim 1 wherein said one of said two internal cam surfaces of said cap member extends substantially parallel to the central longitudinal axis of said track so that a window on which said stay is fitted can only be opened and closed to one side of said stay.

4. The friction stay of claim 1 further comprising a block, said block being secured to said track and said strut being pivotally mounted on said block.

5. The friction stay of claim 4 further comprising a rivet for securing said block to said track and for also pivotally connecting said strut to said block.

6. The friction stay of claim 4 wherein said track comprises a channel having inturned flanges along the extremities of the side walls thereof, and wherein said block is shaped to be located within said channel and is formed with longitudinal recesses to receive said flanges.

7. The friction stay of claim 4 wherein said block has a surface portion which projects above the surface of said track to provide a bearing surface to prevent components of said stay from binding against said track.

8. The friction stay of claim 4 wherein said block extends along a substantial length of the track beyond the area of the pivot point between said strut and said track.

* * * * *